US010870033B2

(12) United States Patent
Johnson

(10) Patent No.: US 10,870,033 B2
(45) Date of Patent: Dec. 22, 2020

(54) DEVICE WITH RECIPROCATING UPPER EXTREMITY SUPPORT ASSEMBLIES

(71) Applicant: Cynthia L. Johnson, Coupeville, WA (US)

(72) Inventor: Cynthia L. Johnson, Coupeville, WA (US)

(73) Assignee: NEUROMOBILITY LLC, Coupeville, WA (US)

( * ) Notice: Subject to any disclaimer, the term of this patent is extended or adjusted under 35 U.S.C. 154(b) by 393 days.

(21) Appl. No.: 15/594,965

(22) Filed: May 15, 2017

(65) Prior Publication Data

US 2017/0326407 A1 Nov. 16, 2017

Related U.S. Application Data

(60) Provisional application No. 62/336,367, filed on May 13, 2016.

(51) Int. Cl.
*A63B 21/00* (2006.01)
*A63B 71/00* (2006.01)
(Continued)

(52) U.S. Cl.
CPC ..... *A63B 21/4045* (2015.10); *A61H 1/0274* (2013.01); *A63B 21/00181* (2013.01); *A63B 22/001* (2013.01); *A63B 22/0005* (2015.10); *A63B 22/0012* (2013.01); *A63B 22/0046* (2013.01); *A63B 22/02* (2013.01); *A63B 22/0235* (2013.01); *A63B 22/203* (2013.01); *A63B 69/0057* (2013.01); *A63B 71/0009* (2013.01); *A61H 2201/10* (2013.01); *A61H 2201/1261* (2013.01);
(Continued)

(58) Field of Classification Search
CPC ..... A63B 21/4045; A63B 21/4035; A63B 21/4019; A63B 21/402; A63B 21/01; A63B 3/00; A63B 22/0012; A63B 22/02; A63B 22/0235; A63B 22/203; A63B 69/00; A63B 71/0009; A63B 2071/0081; A63B 2071/0625; A63B 2210/50; A63B 225/09; A63B 225/093
See application file for complete search history.

(56) References Cited

U.S. PATENT DOCUMENTS 2,362,466 A * 11/1944 Carter ..... A61H 3/04 297/6
2,759,525 A * 8/1956 Ries ..... A61H 3/04 297/6
(Continued)

*Primary Examiner* — Anita M King
(74) *Attorney, Agent, or Firm* — Fay Sharpe LLP

(57) ABSTRACT

An upper body support assembly for use with an associated railed device having first and second rails is disclosed. The assembly includes first and second upper body supports capable of moving along the first and second rails, respectively. The upper body supports have at least one of: (i) first and second forearm supports, (ii) first and second hand grips, or (iii) a first forearm support and a first hand grip. An interconnecting member extends between and selectively connects both the first and second upper body supports to permit (i) interrelated movement therebetween when connected, and (ii) independent movement therebetween when disconnected. The assembly can achieve two point gait, three point gait, and four point gait movement.

21 Claims, 10 Drawing Sheets

(51) Int. Cl.

| | |
|---|---|
| ***A63B 22/02*** | (2006.01) |
| ***A63B 22/00*** | (2006.01) |
| ***A63B 22/20*** | (2006.01) |
| ***A63B 69/00*** | (2006.01) |
| ***A61H 1/02*** | (2006.01) |
| *A63B 3/00* | (2006.01) |
| *A63B 71/06* | (2006.01) |

(52) U.S. Cl.

CPC ..... *A61H 2201/1276* (2013.01); *A61H 2201/1638* (2013.01); *A61H 2201/1664* (2013.01); *A63B 3/00* (2013.01); *A63B 21/4019* (2015.10); *A63B 21/4021* (2015.10); *A63B 21/4035* (2015.10); *A63B 2022/0041* (2013.01); *A63B 2022/0094* (2013.01); *A63B 2071/0081* (2013.01); *A63B 2071/0625* (2013.01); *A63B 2210/50* (2013.01); *A63B 2213/004* (2013.01); *A63B 2225/09* (2013.01); *A63B 2225/093* (2013.01)

(56) References Cited

U.S. PATENT DOCUMENTS 4,529,194 A * 7/1985 Haaheim ..... A63B 21/012 482/70
4,643,418 A * 2/1987 Bart ..... A63B 22/02 482/4
5,499,955 A * 3/1996 Becker ..... A61H 3/00 434/255
5,564,451 A * 10/1996 Hagberg ..... A61H 3/02 135/68
6,264,584 B1 * 7/2001 Bass ..... A63B 69/0064 482/54
6,279,591 B1 * 8/2001 Obitts ..... A61H 3/00 135/66
7,422,025 B1 * 9/2008 Waldstreicher ..... A61H 3/04 135/71
8,007,409 B2 * 8/2011 Ellis ..... A63B 21/0615 482/54
8,075,453 B1 * 12/2011 Wilkinson ..... A63B 21/153 482/51
8,251,079 B1 * 8/2012 Lutz ..... A61H 3/04 135/67
8,573,612 B1 * 11/2013 Fulk ..... A61H 3/04 135/67
9,314,395 B1 * 4/2016 VanAusdall ..... A61H 3/04
9,795,825 B2 * 10/2017 Johnson ..... A61H 3/04
10,543,144 B2 * 1/2020 Johnson ..... A61H 3/04
2010/0113227 A1 * 5/2010 Habing ..... A63B 21/023 482/51
2018/0093125 A1 * 4/2018 Johnson ..... A63B 21/4027
2018/0250189 A1 * 9/2018 Johnson ..... A61H 3/04

* cited by examiner

DEVICE WITH RECIPROCATING UPPER EXTREMITY SUPPORT ASSEMBLIES

This application claims the priority benefit of U.S. provisional application Ser. No. 62/336,367, filed May 13, 2016, the entire disclosure of which is expressly incorporated herein by reference.

BACKGROUND

This invention relates to an ergometer, an exercise machine, specifically a treadmill, with added features related to upper extremity support and movement.

A treadmill allows one to walk or run while staying in the same place. The treadmills are used in medical, rehabilitation, fitness settings and in the home. In rehabilitation settings, treadmills serve many purposes.

The belt on a treadmill can be powered (e.g., electrically) or manually-powered. A non-electric treadmill could be selected for use when the user will walk with a less advanced gait pattern such as one wherein the arms advance independently of the legs. Other reasons include safety, as some users are safer on a non-electric treadmill. Motor-driven machines offer variable velocity ranges. Often the degree of incline can be variably set for either electrical or non-electrical treadmills purposes of varying workload. Treadmills can be portable or non-portable. There exist bariatric treadmills, created to withstand greater loads.

Treadmill control and display panels variably include, for example, the following: power, speed, elevation, exercise time, distance traveled, heart rate (HR), pre-programmed modes for selected types of training, graphic representation of completed work, calories burned, among others. Training/exercise data can often be stored electronically.

When upper extremity (UE) support is not needed when using a treadmill, the user's arms are able to move freely as occurs during overground walking. The natural movement of the arms in human gait is described as reciprocating: as one arm moves in a forward direction, largely in the sagittal plane, the opposite arm moves in the reverse direction. Reciprocating gait results when upper extremities as well as lower extremities (LE) move in reciprocating fashion, and movement of upper limbs is out of phase with that of lower limbs. In the absence of neurologic or musculoskeletal or other dysfunction, the amplitude of this 'normal' and desirable movement of the UEs varies among individuals, and is automatic, when arms are unsupported and free to move. Frequency and amplitude of movement can volitionally be altered. Arm movement during locomotion serves multiple functions, including assisting with balance, decreasing energy demands, neurologically facilitating movement of the LEs, and many others.

Typically, rails are situated at the front and/or along the sides of treadmills, for static UE support when needed. Treadmill rails are typically round. Rail height is sometimes adjustable. Typically, as gait velocity increases, so too does the degree of support needed. When upper body support is needed, the user grips one Or both railings. Adequate upper body strength, range of motion, and function are needed in order to safely and effectively use treadmills. When rails are grabbed statically, the UEs are effectively immobilized, remaining in the same position relative to each other and to the user's torso. It would be desirable if UE movement similar to movement which occurs during normal human gait could be achieved when grip support is needed unilaterally or bilaterally on a treadmill. In some cases, a user's gripping function is impaired on one or both sides. It would be desirable to have a means to effectively and efficiently secure a wrist and hand to the gripping support surface, regardless if static or mobile support is desired. It would also be desirable to be able to move the upper extremities as needed, for gait patterns necessitating UE support, such as two, three, and four point gait patterns.

As is the case with other mobility aids and gait training devices such as walkers and parallel bars, sometimes forearm support is needed or otherwise desirable instead of gripping the mobility aid grip or the rail of the device. Multiple clinical reasons exist for incorporating forearm platform support. There exist forearm support assemblies which can be attached to walkers and parallel bars, and there are walkers and rollators with forearm support assemblies intrinsic to the device. Forearm supports which can be installed temporarily on treadmill rails are not available, nor are there treadmills with forearm supports intrinsic to the device; both would be desirable. It would be desirable if forearm supports could be used unilaterally or bilaterally, and could be used for static support as well as for mobile support.

Typically, gait training and ambulation activities involving discontinuous or slower stepping (i.e., the less advanced gait patterns such as two, three and four point gait) is not conducted on treadmills, as electric treadmills demand continuous stepping and continuous mobile support such as would be needed on nonelectric and electric treadmills in order to walk with less advanced gait patterns has not been available until now. It would be desirable if mobile UE supports included a braking functionality, and if the UE supports could be moved independently of each other such that they could both be advanced simultaneously, in tandem, or in reciprocating fashion or other, depending on the gait pattern to be achieved. Commonly owned applications include Ser. No. 62/001,353, filed May 21, 2014 (update); 62/043,807, filed Aug. 29, 2014 (update); 62/091,191, filed Dec. 12, 2014 (update); Ser. No. 14/719,311, filed May 21, 2015; and 62/250,291, filed Nov. 3, 2015 (update), and the entire disclosure of each is expressly incorporated herein by reference.

In addition to general gait and exercise training, treadmills are used for repetitive stepping training as is recommended for neurologic recovery as well as other therapeutic benefits. Locomotor principles guide this type of rehabilitation, used to treat those afflicted by neurologic disease such as stroke, Parkinson's Disease, spinal cord injury, multiple sclerosis, cerebral palsy, as well as other patient populations, and includes the following: "(i) generating stepping speeds approximating normal walking speeds (0.75-1.25 m/s), (ii) providing the maximum sustainable load on the stance limb, (iii) maintaining an upright and extended trunk and head, (iv) approximating normal hip, knee, and ankle kinematics for walking, (v) synchronizing timing of extension of the hip in stance and unloading of limb with simultaneous loading of the contralateral limb, (vi) avoiding weight bearing on the arms and facilitating reciprocal arm swing, (vii) facilitating symmetrical interlimb coordination, and (viii) minimizing sensory stimulation that would conflict with sensory information associated with locomotion." (See, Fulk et al U.S. Pat. No. 8,573,612). A need exists to enable adherence to a greater number of these locomotor training principles. Indeed, a mechanical device or means to achieve repetitive reciprocating movement of supported UE(s) is needed during locomotor training in all environments—e.g., treadmills, parallel bars, overground. Such movement could be achieved variably by active movement of the UEs or via an external power source. Such a mechanism would be useful for other gait and exercise training endeavors on treadmills as well. Locomotor training also encompasses overground and community ambulation. Various technologies such as body weight support (BWS), BWS treadmill training (BWSTT) technologies, robotic exoskeletons and other, are variably incorporated with treadmill systems for this type of training, for purposes of provision of support and to reduce the amount of lower body weight bearing, hence enabling stepping, prolonged training, and stepping at higher frequencies, among other things. During BWSTT, manual assist is often provided, typically just to the LEs. Management of the UEs is variable yet typically lacking in terms of proper support, positioning, and adherence to recommendation to move in reciprocating fashion. A mechanism or means to support and appropriately position the upper limbs and to enable/facilitate/potentiate repetitive reciprocating arm movement for this type of training done on treadmills is needed.

The commonly owned patent applications noted above present solutions for achieving mobile upper extremity support and reciprocating movement of support assemblies on railed devices in Ser. No. 14/719,311 and 62/250,291. Solutions to achieve reciprocating (out of phase) arm movement, as well as reciprocating (back and forth movement, to the degree needed or desired) movement of one support assembly independent of the second support assembly, are provided in these applications as well as the current application. Application 62/250,291 describes a walker. One component of this device, the assembly comprising the mobile upper extremity supports, is incorporated in one embodiment in this document. The support assemblies can be locked in place for static support, can be linked such that movement of one assembly causes the other assembly to move in the reverse direction, or can be unlinked such that the two UE can move independently. Braking functionality is provided in this assembly. With respect to incorporation of this assembly on a treadmill, the braking feature would be advantageous particularly on a non-electric treadmill, yet also functional on an electrical treadmill operating with low belt speeds, as it would enable stable positioning of one UE such that the opposite LE could be advanced (i.e., four point gait). It will be understood that braking functionality can be added to other embodiments of mobile assemblies proposed herein.

Forearm supports encourage erect posture and can facilitate reduction in upper body weight bearing as compared to gripping. Conversely, as the amount of bodily support is diminished during stepping training in any environment (treadmill, parallel bars, overground), or in the absence of technologies which provide bodily support, there exists a need for provision of a mechanism or means to facilitate greater upper body support such as a forearm support can offer, as opposed to gripping a rail or grip handle.

During any type of treadmill training, users may or may not have the cognitive and/or physical ability to move the arms in reciprocating fashion, repetitively, or may be only able to do so for abbreviated periods of time. Mechanization of this reciprocating movement would be desirable as it would enable selective velocity control, quantification of movement data, facilitating longer sessions of use of the device, symmetrical movement, and the like.

One or both UE may be dysfunctional and in need of support and/or therapeutic mobilization. A need exists for a way to accomplish support and mobilization of affected upper limb(s) on a treadmill, to enable more individuals to use a treadmill as well as to improve therapy by incorporating functional, neurologically-facilitatory movement of the UEs. A way to achieve this with devices which can be used on railed devices and with a walker is described in my above referenced applications. Mobilization of one UE by the opposite UE can be accomplished with a mechanical linkage intact; mobilization of one or both UE can be accomplished when the interconnecting linkage is disconnected and mechanization of reciprocating movement of an assembly is accomplished.

In cases such as cerebral vascular accident (CVA), where one UE may function normally and the other UE may be dysfunctional, it would be desirable if forearm support could be used on one side and grip handle support on the other (sound) side.

Other types of ergometers such as elliptical trainers and stair stepping machines are often designed with reciprocating levers, enabling some form of reciprocating arm movement, each UE reciprocating along its path and the UEs reciprocating, or moving out of phase. Other ergometers provide for a way to move the UEs in reciprocating fashion which is more similar in appearance to normal arm swinging motion. Some treadmills have mobile levers which the user can grab and move back and forth. Mobile forearm support has not been available until now.

A way to be able to support one or both UE (via grip handle or forearm support, placing the elbow in more extended or flexed positioning respectively). and for the support(s) to be able to be used statically or as mobile support(s), and to be able to move one or both supports in reciprocating fashion, and a way to cause the supports to move consistently in symmetrical, reciprocating fashion when supports used bilaterally, on a treadmill is needed as is enablement of independent movement—each UE moving to the extent and in the direction needed or desired, depending on the gait pattern selected.

A need exists for an improved arrangement that provides at least one or more of the above-described features, as well as still other features and benefits.

SUMMARY

Various embodiments of treadmills are disclosed which offer mechanical arrangements that enable movement of one or both upper extremities (UE) in a forward/backward manner such as occurs during normal human gait.

A treadmill is provided which can be variably electric or manually-driven, for use in combination with the components comprising upper extremity supports and related mechanisms.

A treadmill is provided which allows for interchangeable grip handle and forearm support assemblies, unilateral or bilateral, in any combination: two (2) forearm supports, two (2) grip handle supports, or one (1) forearm support & one (1) grip handle support.

The support assemblies can be variably positioned relative to the stepping surface of the treadmill, and relative to the other side, when statically positioned.

One embodiment of the treadmill is provided which enables variable neutral positioning of the UE supports to be used as mobile supports, such as might be desirable when a grip handle is used on one side and a forearm support on the other side.

Upper extremity support assemblies can be used unilaterally or bilaterally, and can be used for static or mobile support.

A treadmill is provided which enables upper limb support to the degree needed for stable ambulation.

A treadmill is provided with UE support surfaces which can be variably positioned for optimal fit and function (with respect to a user's position on the treadmill).

A treadmill is provided which has height-adjustable support surfaces which can be adjusted independently of the opposite side.

A treadmill is provided which provides a mechanism or means that more readily secures a distal portion of an upper limb to the frame/rail of the device when gripping support is desired.

A treadmill is provided that has the ability to move one or both UE when the UE is supported.

A treadmill is provided which enables the UEs of the user to move in reciprocating fashion when upper extremities are supported bilaterally or alternately one supported limb can move independently of movement of the opposite UE.

A treadmill is provided which has mobile UE supports which can be braked by the user along the rail upon which they glide, such as could be desirable after advancing one or both UE such that a step can be taken once UEs are statically positioned, such as could be performed on a nonelectric treadmill with two, three, or four point gaits.

The embodiment which offers the braking functionality offers a way that the two UE support assemblies can be linked for movement in reciprocating fashion, or can be unlinked such that the UEs can move independently. Both options provide a mechanism to achieve gait patterns which advantageously incorporate the braking functionality.

A treadmill is provided which can incorporate various mechanical mechanisms or means that couple reciprocating motion (reverse motion) of the UE support surfaces which are mobile with respect to the fixed frame of the device. This mechanism can be externally-powered.

A treadmill is provided which enables therapeutic mobilization of one or both involved upper limbs, in a reciprocating manner.

A treadmill is provided which offers a way to achieve repetitive reciprocating movement of UEs as is a desirable component of repetitive stepping training on a treadmill as well as during other gait and exercise training activities.

A treadmill is provided with mobile assemblies which glide along a rail which is a component of the assembly placed upon the frame of the treadmill.

A treadmill is provided with mobile assemblies which glide along the rail which is a component of the treadmill frame.

A treadmill is provided with track(s) attached to the rail, upon which support assemblies can glide. Tracks can be separate or continuous, straight or curved.

A treadmill is provided with a unique rail shape which accommodates a congruent mobile unit which can glide along the rail and which has inherent rotational stability about the rail.

Treadmills are provided which facilitate the achievement of erect posture, improved LE kinematics, symmetrical interlimb coordination, reciprocating arm movement and minimalization of UE weight bearing when this is desired.

A treadmill is provided which enables more efficient gait, achieved via normalization of gait kinematics as compared to a gait pattern which results when one statically grips one or both rails of a treadmill.

A treadmill is provided which has an intrinsic mechanism (e.g., positioning of an UE support assembly upon the rail, such as at end range of excursion) which can be linked to an auditory signal found useful for facilitation of gait in populations such as those with Parkinson's Disease.

A treadmill is disclosed which encourages maintenance of body positioning relative to the treadmill frame which is deemed most safe and functional.

A treadmill is disclosed which enables symmetrical movement of the upper extremities, facilitates training in interlimb coordination, and provides a mechanism to achieve reciprocating, rhythmical movement of the upper extremities during ambulation activities.

A treadmill is provided which offers enhanced safety as related to provision of forearm supports as well as grip handle supports which a distal upper extremity can be secured to more readily and effectively with an orthosis, than can be achieved by securing to the rail of a treadmill.

A device is provided that enables achieving higher aerobic intensities during functional stepping activities, when this is desired, as related to the enablement of UE movement.

A treadmill is provided to which mechanization could readily be added to adjust the amplitude and velocity of arm movement.

A treadmill is provided to which instrumentation devices could be added for collection and storage of data related to weight borne through the UE, the number repetitions of arm movement, among other things.

A treadmill is provided with mobile UE supports and related mechanisms intrinsic to the device, or these components can be temporarily installed.

A treadmill is disclosed which provides for continuum of care as similar therapy done in the clinic in railed environments and with a walker can be done on a treadmill in a clinic and in the home.

A system and method is provided for gait, locomotor, exercise training with reciprocating movement of the upper extremities which can be combined with reciprocating stepping activity.

A system and method is provided for an ergometer/treadmill which provides at least one of the following: any combination of forearm and grip handle supports which can be used unilaterally or bilaterally for static support or mobile support; a mechanical mechanism or means that enables and facilitates and potentiates reciprocating UE movements; a mechanical mechanism or means that mobilizes an upper limb(s) in a functional manner by the opposite UE or via an external power source; a treadmill which facilitates adherence to a majority of the locomotor training principles as delineated above; a treadmill which offers continuous upper body support which can be advanced and subsequently braked such that the opposite lower limb can be advanced.

Benefits and advantages of the present disclosure will become more apparent from reading and understanding the following detailed description.

BRIEF DESCRIPTION OF THE DRAWINGS

FIG. 2A illustrates (individual) lengths of straight track, each positioned upon an associated one of the two rails, similar to the arrangement shown in FIG. 1, FIG. 2B illustrates incorporation of a reverse motion (cable) linkage in conjunction with the track system in FIG. 2A, and FIG. 2C illustrates a curvilinear track system placed on one rail.

FIG. 8A is a perspective view, and FIG. 8B is a perspective view with selected portions of the housing removed for ease of illustration.

FIG. 12A shows two (2) forearm support assemblies, FIG. 12B shows two (2) grip handle assemblies, and FIG. 12C shows one (1) forearm support assembly and one (1) grip handle assembly.

DETAILED DESCRIPTION

With reference to the accompanying Figures, there are shown railed devices (treadmills, walkers, parallel bars, etc.) and particularly treadmills of various types (powered/electric, manually-powered/non-electric, etc.), with the novel introduction of mobile upper extremity support assemblies. The components which allow for this added functionality may be intrinsic to the design of the customized railed device or treadmill, or variably they may be temporarily installed. One or both upper extremities may be supported, and static or mobile support can be achieved. Independent active arm motion or with specialized linkage(s) engaged, reciprocating motion is created/enabled. Forearm or grip handle support options and orthotic solutions to optimize distal upper extremity function are presented.

Figure 1:
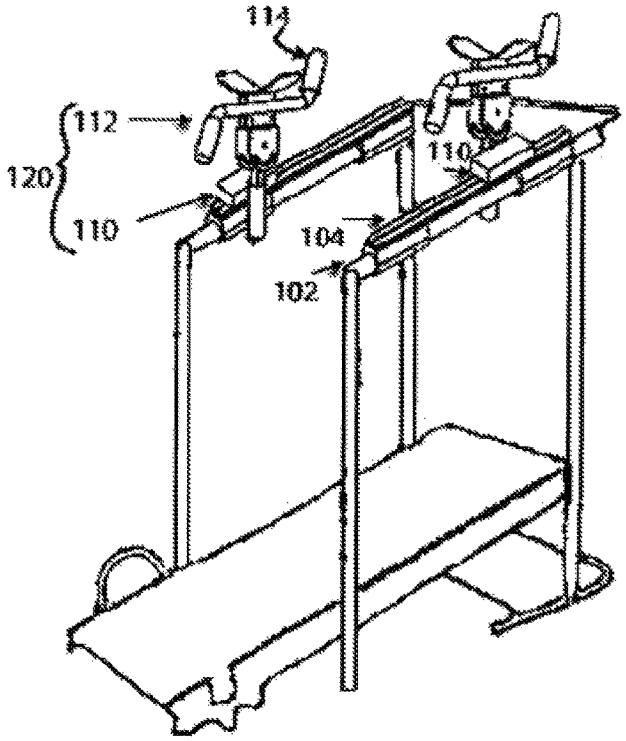
FIG. 1 shows an unpowered or manually operated treadmill which includes tracks mounted on the side rails which provide a mechanism to achieve mobile upper extremity support, and variably an electric treadmill could be incorporated.
Figure 2A:
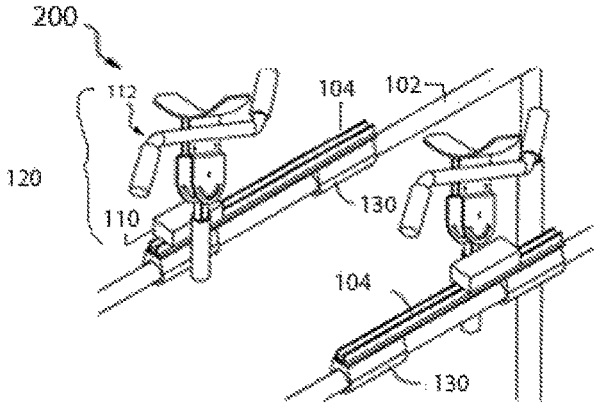
FIGS. 2A-2C are illustrations of rails and tracks which could be integrated with a treadmill in order to achieve mobile upper extremity support, where
Figure 2B:
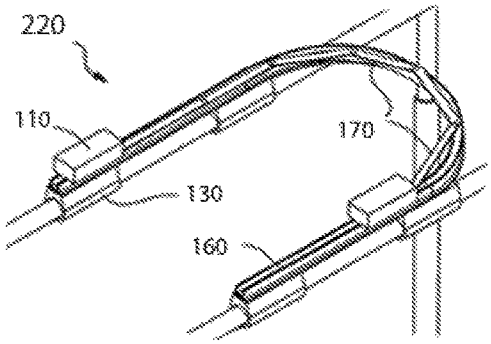
Figure 2C:
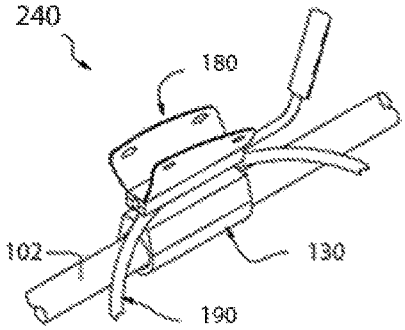

One method to accomplish mobile upper extremity support in a treadmill environment is by utilizing tracks 104, and as is illustrated in FIGS. 1-2C. FIG. 1 shows a manually powered or non-electric treadmill with tracks 104 attached to side rails 102 where the side rails are identical unless noted otherwise. A support surface such as a forearm platform assembly 112 can be readily attached to a railed device 110 where the platform assembly stably glides along the track 104, hence creating a mobile support assembly 120. Alternately, a grip handle 114 such as one shown in FIG. 16A-16E could be incorporated on one or both sides. The forearm support 112 included in FIG. 1 has a two-handled grip 114, which enables the user to face the other end of the treadmill and take reverse steps, by simply rotating the handle portion 114 of support assembly 120 one hundred eighty (180°) degrees. FIG. 2A illustrates the rails 102 and components of FIG. 1 in more detail and this system is identified by reference numeral 200. The track 104 may be attached to the rail 102 by device(s) 130 (shown here as a sleeve-like device) which serves to stably position the tracks in a selected position along the rails. Four of these devices 130 are shown in FIG. 2A, although a greater or lesser number can be used as long as the desired stability is achieved. The user is able to actively move the upper extremities with an arrangement such as this. Addition of a reverse motion linkage to such an assembly would result in the following: movement of one mobile assembly 120 in one direction on one rail 102 would cause the mobile assembly on the opposite rail to move in the opposite direction, i.e., a reverse-motion linkage assembly. One exemplary configuration is presented in FIG. 2B. Support surfaces have not been added for ease of illustration and simplification purposes. Reverse motion linkage assembly 220 functions as follows: the track 160 is secured to both rails 102, by two or more (four shown here) devices 130 of the type as shown for example in FIG. 2A. Two pieces 110 glide along the track 160 and provide the surfaces to which the various UE support surfaces are attached. A cable 170 is connected to each of the two pieces 110 and is securely mobilized through a housing which is or rests on a spanning member extending between the rails 102. Alternately, another connection between the pieces 110 is envisioned, via mobile components contained within or along the track 160. As other reverse motion linkages accomplish, movement of a weak limb can be potentiated by a stronger limb, for example. Alternately, reverse motion linkage assemblies such as those illustrated in FIGS. 5A-5C could be readily incorporated with a track system. A mobile assembly 240 including a curved track 190 is introduced as follows. FIG. 2C shows a forearm trough 180 with an undersurface equipped with rollers, bearings, or any of several other equivalent mechanisms to accomplish secure mobility (i.e., relative sliding) along a track 190. The assembly 240 is attached to rail 102 by device 130. The track 190 is curvilinear which enables more movement of the UE in the transverse plane as occurs when the arm swings naturally, as compared to straight sagittal plane movement which is facilitated with use of track(s) such as 104 in FIG. 2A. Forearm supports 112 or grip handle supports 114 could be used with this embodiment, depending on the radius of the curved track (smaller radius-forearm support; larger radius-grip handle support). Either of these tracks (straight or curved) can be used unilaterally or bilaterally. Mobile assembly 240 could also function so as to create reverse motion between assemblies, as follows: track 190 would be continuous, and cable linkage connecting assemblies would be provided. One skilled in the art will recognize that these are merely illustrative of a wide range of linkage assemblies, track assemblies, etc., that may be used to accomplish desired movement of the UEs in supported relation relative to one bar/rail or relative to a pair of parallel bars/rails.

Figure 3:
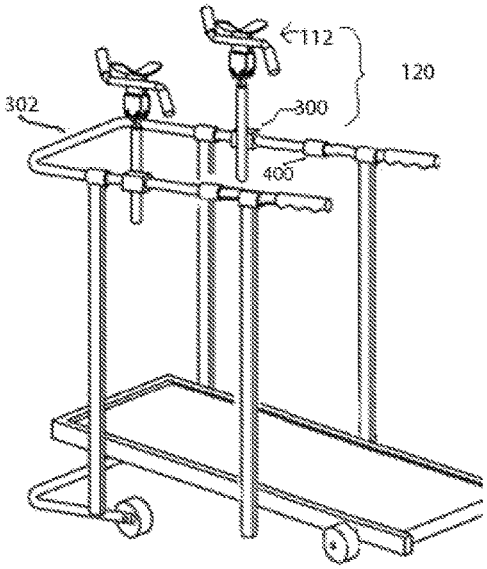
FIG. 3 shows an unpowered or manually operated treadmill with an alternate method of achieving mobile upper extremity support via incorporation of mobile units attached directly to the rail(s), and variably an electric treadmill could be incorporated.
Figure 4A:
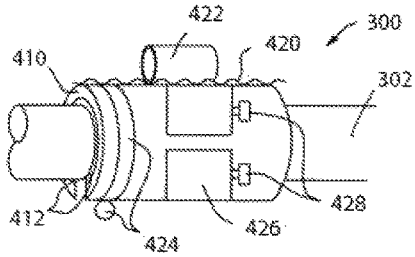
FIGS. 4A and 4B are illustrations of side views and cross sectional views, respectively, of a rail linkage assembly which conforms to round rails of various diameters.
Figure 4B:
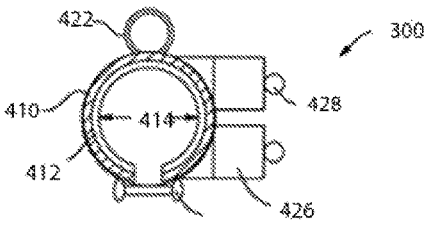
Figure 4C:
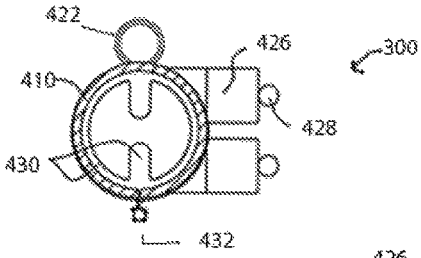
FIG. 4C is cross sectional view of an alternate rail linkage assembly of (unique configuration to accommodate a rail of unique shape)

Yet another manner of achieving mobile UE support in a treadmill environment is shown in FIG. 3. A forearm support assembly 112 is attached to a device 300 which glides along the rail 302 creating the mobile assembly. Details of device 300 are shown in FIGS. 4A-4C. This device is called a rail linkage assembly 300 as it is attached directly to, and glides along, the associated rail 302. Alternately, grip handle(s) 114 can be incorporated on one or both sides instead of forearm assemblies 112. A non-electric treadmill with bilateral, unlinked mobile assemblies 300 is illustrated in FIG. 3. In this example, motion stops 400 are placed at ends of each of the rails 302 to delimit translation range of the assemblies 300. Upper extremity support 112/114 can be used unilaterally or bilaterally, and if used bilaterally, the mobile assemblies 300 can be unlinked or linked with reverse motion linkages such as those illustrated in FIGS. 5A-5D.

With reference to FIGS. 4A and 4B, there is shown side view and cross sectional views of rail linkage assembly 300. The assembly 300 is, for example, composed of a rigid sleeve-like member 410 such as a metal (e.g., steel or aluminum), polymer, composite, etc., sleeve or collar of variable thickness, lined with a material such as a self-lubricating polymer, e.g., an ultra-high molecular weight polyethylene (UHMWPE) 412, that facilitates sliding movement of the sleeve/collar 410 relative to the rail/bar 302 on which the assembly 300 is mounted. The polymer lining is cut to be of variable thickness and geometry (and hence variable cross-sectional shape) following lining the sleeve 410 with the layer of material, such that the lined sleeve conforms to the rail 302 onto which the lined sleeve will be attached and along which the assembly 300 will translate. Rail linkage assemblies 300 with a sleeve or collar fitting rails 302 of variable shape other than round, will not freely rotate about the long axis of the rail; as such, vertical, rotational stability of the device will be inherent, and a mechanical linkage will likely not be needed for this purpose. The resultant inside profile or diameter 414 of the sleeve (FIG. 4B) is the same as or equal to the outside profile or diameter of the rail 302 onto which the sleeve 410 is attached, in the case of a round railing. The polymer can be backed with an adhesive and hence affixed to the internal surface of the sleeve 410, or attached in other ways so as to enable exchanging and reusing sleeves readily. The sleeve can be simply removed and replaced with an alternate sleeve/collar, such that the rail linkage assembly 300 can be used on an alternate rail 302 if desired. For example a slit is cut lengthwise along the sleeve/collar 410 and the assembly is hinged at 420 (FIG. 4A) to enable opening such that the assembly can be opened and put on a rail 302 and subsequently secured in place. A tube weldment 422 is located on the top (or other surface) of the sleeve/collar 410 and receives and secures a linkage such as might be needed for stabilization purposes of the device about the rail 302. A fastener 424 serves to approximate the two separated edges of the sleeve/collar 410 and can be tightened or loosened in order to vary the amount of friction when the device moves relative to or glides along the rail 302. The fastener 424 can be of any design/configuration and one or more could be incorporated as needed to achieve friction adjustment of the sleeve/collar 410. It is also contemplated that instrumentation of the fastening device would be desirable to allow objective measures of resistance to movement hence incorporated. One or two tube clevises 426 are secured via welding or other mechanism to one side of the device (attached medially in the Figures illustrated) and serve as the receptacle for an upright tube which is the elected attachment mechanism in this design, of the various UE support assemblies. Tightening screws 428 serve as one option of a method to tighten the tube clevis around the tube. It is also contemplated that the sleeve/collar 410 and inner lining could be a single component, i.e., the lining integrally formed as a part of the sleeve such as a reinforced polymer collar that includes a lubricious material (or is inherently lubricious) to facilitate manufacture of the arrangement. Again, the present disclosure is intended to illustrate one preferred embodiment but is not deemed to be limited to only this embodiment.

FIG. 4C is a cross sectional view of device 300 which has a plastic lining 430 with two projections which run longitudinally within the device, and which is fabricated to accommodate a railing of alternate shape (i.e. one with longitudinally-running grooves along the superior and inferior aspects). The same device 300 is lined in this example with a specified thickness of plastic, for example, which lines a portion of each hemisphere of the sleeve/collar, and has projections on the top and bottom in this example which accommodate a rail 302 with mirror image indentations. As is illustrated here, the 300 can be longitudinally split and the two portions hinged to enable opening the device to put on a rail 302 and subsequently secure with the fastening screws(s) 432 which simply secure the abutting edges of the sleeve/collar 410 together as opposed to serving as a progressive tightening mechanism. Functionally, a device which conforms to a noncircular rail 302 such as this would be inherently stable. A reverse motion linkage assembly such as one shown in FIGS. 5A-5D could be incorporated via attachment site such as a tube weldment 422.

Figure 4D:
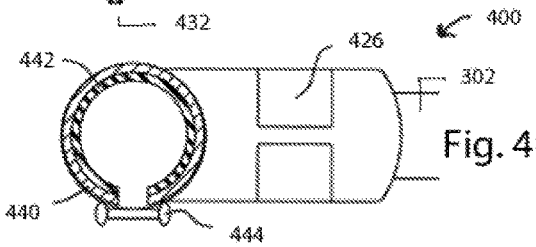
FIG. 4D is a side view of a motion stop block.

A motion stop assembly 400 (FIGS. 3 and 4D) can be placed at variable distances on either side of the rail linkage assemblies 300 in order to delineate a prescribed translation range along the rail 302 in a manner as described above. FIG. 4D is a cross sectional view of such a motion stop assembly. Reference numeral 440 denotes the sleeve or tube that can be received around rails of different or variable dimensions. A compressible rubber or similar material 442 lines the tube 440, and when the tube is secured in place on the rail by tightening a fastener 444, the motion stop assembly 400 is not capable of translation and hence is stationary. Tube clevises 426 may be included in order to use the assembly 400 as a stationary support as opposed to a mobile assembly if so desired.

FIGS. 5A-5D show different reverse motion linkage assembly options 500, 530, 560, and 590. Note that the UE support surfaces have not yet been attached to the reverse motion linkage assemblies, for simplification purposes. This type of linkage serves to potentiate out of phase movement of the UE assemblies. The mechanical linkage will serve to transfer the energy from movement of one unit to the other, thereby facilitating reciprocating movement of the UEs and creating a mechanism to achieve symmetrical, rhythmical upper body motion. Also, an involved (i.e. dysfunctional) UE can be therapeutically mobilized by a stronger limb. The apparatus of the present disclosure could variably be used to enable introduction of an external power source for movement of the devices, for example with variable speed adjustment, if desired. Mechanical control would supply the stimulus which is not infrequently needed to create unilateral or bilateral UE movement during walking activities, and the mechanical control would also create symmetrical excursion distances of both UEs which is desirable. Repetitive reciprocating UE movement during gait training activities is thought to facilitate recovery of lower body function. Hence, this apparatus (treadmill with reciprocating mobile UE support assemblies) will serve a very important role in neurologic rehabilitation as well as other types of rehabilitation and exercise training activities.

A resistance component can be incorporated when manually-powered to enable greater upper body strengthening when using this linkage. An additional sensory feedback device such as an audible signal can be turned on/off when one mobile UE assembly or platform reaches a position at either end of the maximum excursion distance relative to the other unit. This is an optional feature and will benefit certain patients such as those with Parkinson's Disease. It is also intended that the linkage assembly(ies) can accommodate various types of supports 112 or grips 114 being mounted on the mobile mount or rail linkage assemblies 300. When any of the reverse motion linkage assemblies is used on a treadmill, an immobile rail linkage device 502 such as a motion stoppage block 400 or other device which can serve as an attachment point for each end of the linkage member which spans the two rails 510 can be easily designed and could be readily equipped with a mechanism on the superior surface with which to secure the spanning member of the linkage or the tracks such as in FIGS. 2A-2C. Mobile units 300 would be used for attachment of upper extremity support surfaces to enable arm movement, such as the rail linkage assembly in FIG. 4A or FIG. 4C, depending on rail type.

Figure 5A:
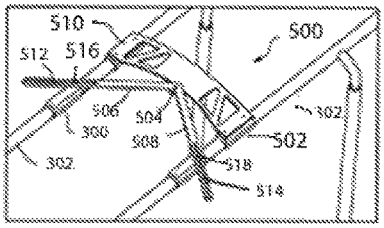
FIGS. 5A-5D illustrate reverse motion linkages in combination with rail linkage units on a railed device.

FIG. 5A shows a reciprocating mechanical linkage 500 in place on a railed device such as a treadmill. The reciprocating mechanical linkage 500 provides for out of phase movement when first and second rail linkage assemblies (and hence whatever support surface is attached thereto) are secured to parallel rails. Indeed, the movement of one rail linkage assembly in either direction can independently cause motion in the opposite direction of the opposite assembly. Mobile UE assemblies are secured to parallel rails of the treadmill. More particularly, the linkage assembly 500 includes a spanning member 510 that extends between the first and second rails 302. A pivot such as generally centrally disposed pivot 504 is provided on the spanning member 510. The pivot 504 mounts first and second links 506, 508 to the spanning member. In this embodiment, the first and second links 506, 508 are disposed in fixed relation to one another, shown here at an included angle of approximately 90 degrees relative to one another. In addition, the links 506, 508 each include an elongated slot or opening 512, 514, respectively. The length of the links 506, 508, the included angle, and the length of the respective openings 512, 514 are designed so that the out of phase movement that is associated with arm movement during a normal gait can be achieved. The links 506, 508 of the linkage assembly 500 rotate about pivot 504 and facilitate the out of phase movement of the UEs. Pins 516, 518 extend from the mobile UE assembly 300 for receipt through a respective opening 512, 514. As is evident in FIG. 5A, the pin 516 is located adjacent to one end of the opening 512 in the first link 506 associated with one of the mobile UE assemblies, and in similar fashion the pin 518 is located adjacent to the other end of the opening 514 in the second link 508 associated with the other of the mobile UE assemblies.

Figure 5B:
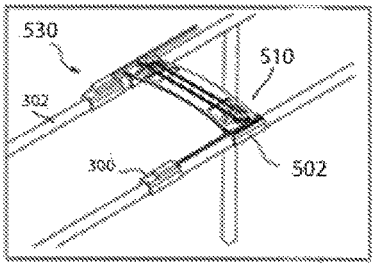
Figure 5C:
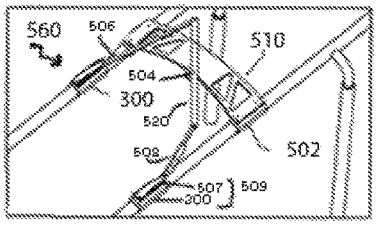
Figure 5D:
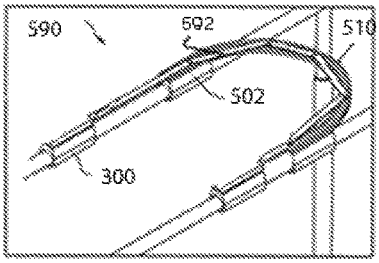

FIG. 5B shows reverse motion linkage 530 in place on a railed device such as a treadmill. The first and second rail linkage assemblies 300 each move relative to their respective rail 302, and each moves relative to one another via an interconnecting flexible member such as a wire, cable, etc., received around one or more pulleys. Thus, as one of the assemblies 300 moves rearwardly, the other assembly moves forwardly. In FIG. 5C a different mechanism is shown. A three bar linkage assembly is shown that includes a central arm pivotally mounted at pivot 504 to the cross member or spanning member 510 that extends between the first and second rails or parallel bars 302. Opposite ends of the central arm 501 are, in turn, pivotally connected to link arms 506, 508 that are pivotally connected at their distal ends to respective first and second rail links e assemblies 300. Upper extremity support assembly 507 (grip handle or forearm support or gripping surface, for example) is mounted on rail linkage assembly 300 creating a mobile upper extremity support assembly 509. The cross member 510 is mounted on rails by rail linkage assemblies 502 which can be statically positioned or slidingly engaged on the rails. Thus, the crossmember remains fixed in place on the rails or can move relative to the rails, as mobile assemblies 509 can move relative to its own rail. In FIG. 5D, still another variation of a reverse motion linkage assembly 590 is illustrated. Here, additional links or arms 592 are pivotally connected to one another and to the assembly 300. A cable could also attach to the rail assemblies and travel along the U-shaped track. The cross member has a generally U-shape and includes a track or groove that receives connection members or pins that join the individual links together, and partially constrain relative movement or orientation as the rail linkages move to and fro.

Figure 6:
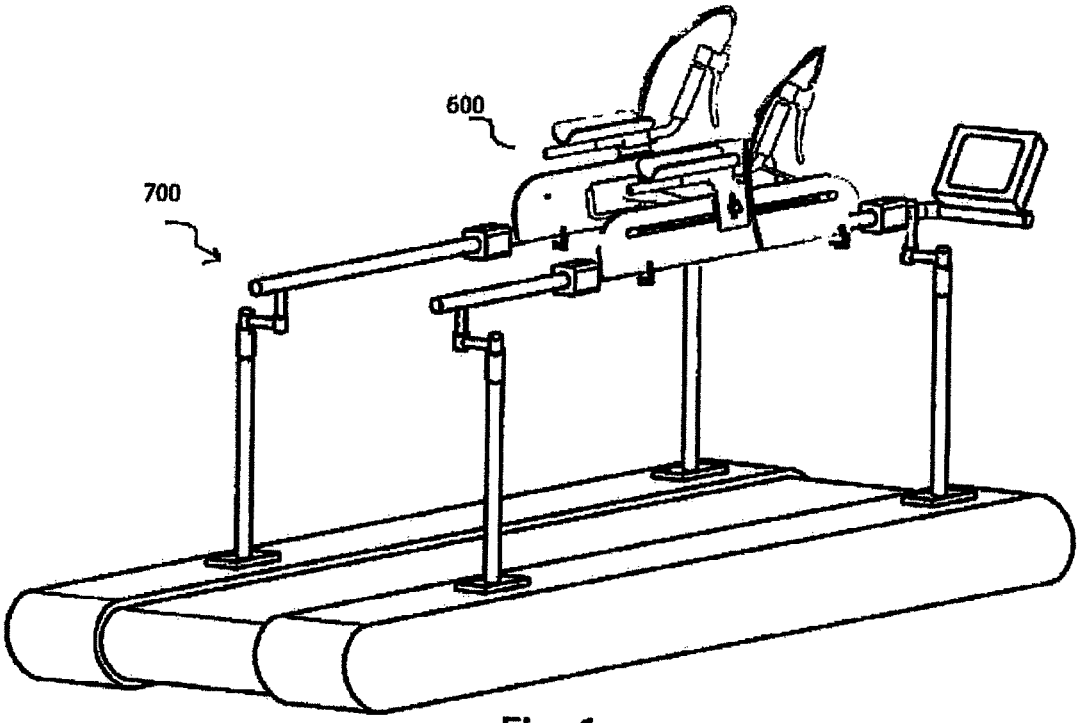
FIG. 6 shows the detachable reciprocating upper extremity support assembly installed on a clinical treadmill with round railings, and motion stop blocks are in place to prohibit movement of the assembly with respect to the rails.
Figure 7:
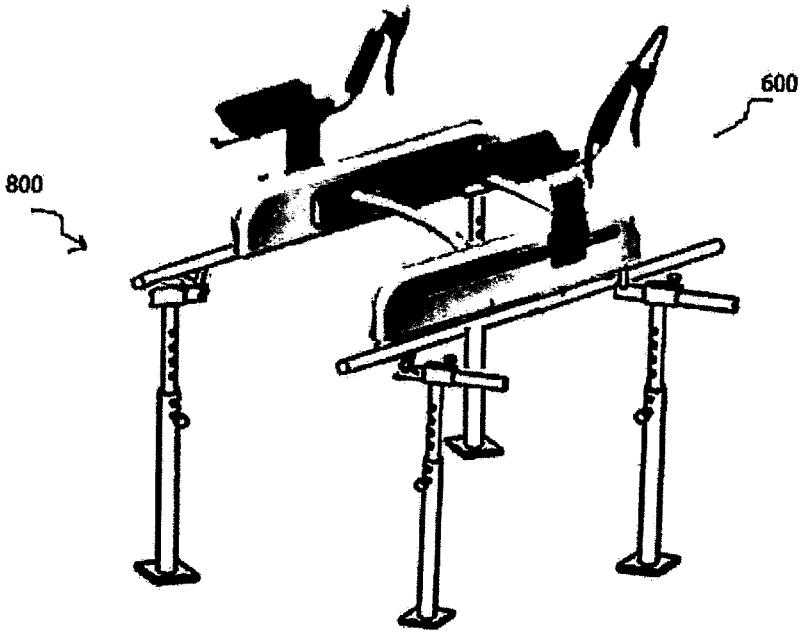
FIG. 7 shows the reciprocating upper extremity support assembly installed on a foreshortened set of parallel bars, and in this embodiment, motion stop blocks and clamps are not in place and engaged (respectively), and the assembly is free to move as a unit along the length of the rails.

Additional embodiments providing a way to support and enable reciprocating (or other) movement of an UE or UEs of a user (not shown) having various needs are illustrated further in FIGS. 6-14. FIG. 6 shows a one piece reciprocating UE support assembly 600 attached to the rails of a powered treadmill 700. The one piece reciprocating UE support assembly 600 is secured in place by clamps 670. FIG. 7 shows the one piece reciprocating upper extremity support assembly 600 attached to the rails of parallel bars 800. The contacting surface of the assembly 600 in FIG. 7 could be fit with (bearings/rollers) such that the assembly can glide as a unit along the rails as opposed to being secured in place as accomplished in FIG. 6, FIG. 8A shows a one piece reciprocating UE support assembly 600 which can be temporarily installed on a railed device such as a treadmill or parallel bars. This type of assembly 600 could also be made to be integral to a treadmill by permanent attachment of a lower surface of the assembly to the rail 630. In one arrangement, a casing such as a plastic casing 620 shows how the assembly 600 was designed to attach to walker frame, and for accommodating rails 630—either round or rectangular. FIG. 8B shows assembly 600 with plastic casing 620 removed from the lateral aspect in order to show device details.

Figure 8A:
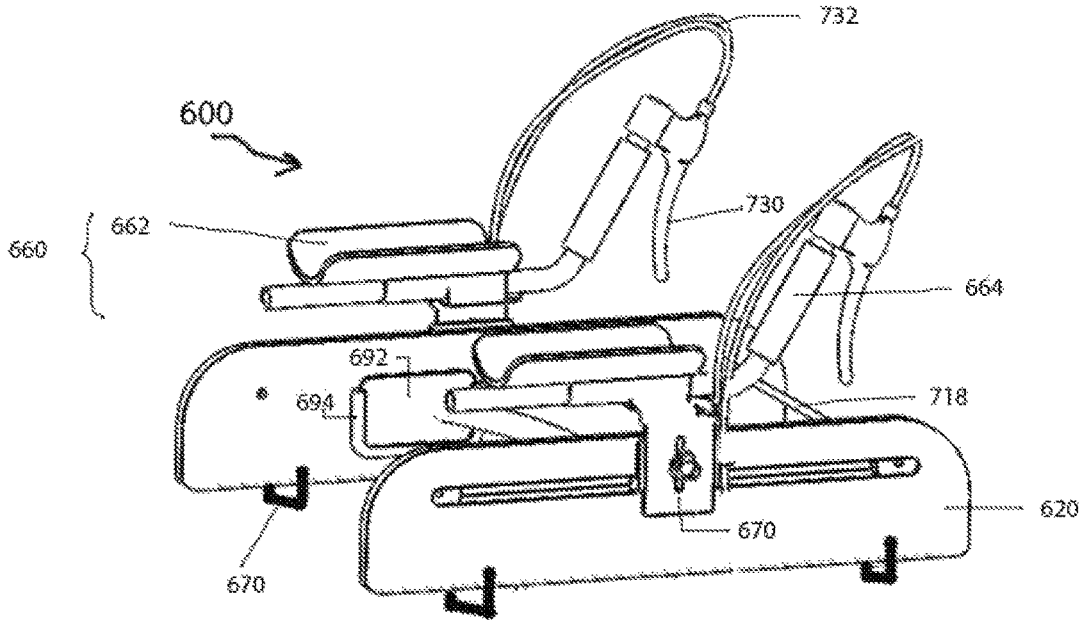
FIGS. 8A and 8B show a one piece reciprocating arm movement assembly which can be temporarily attached to a railed device with round rails where
Figure 8B:
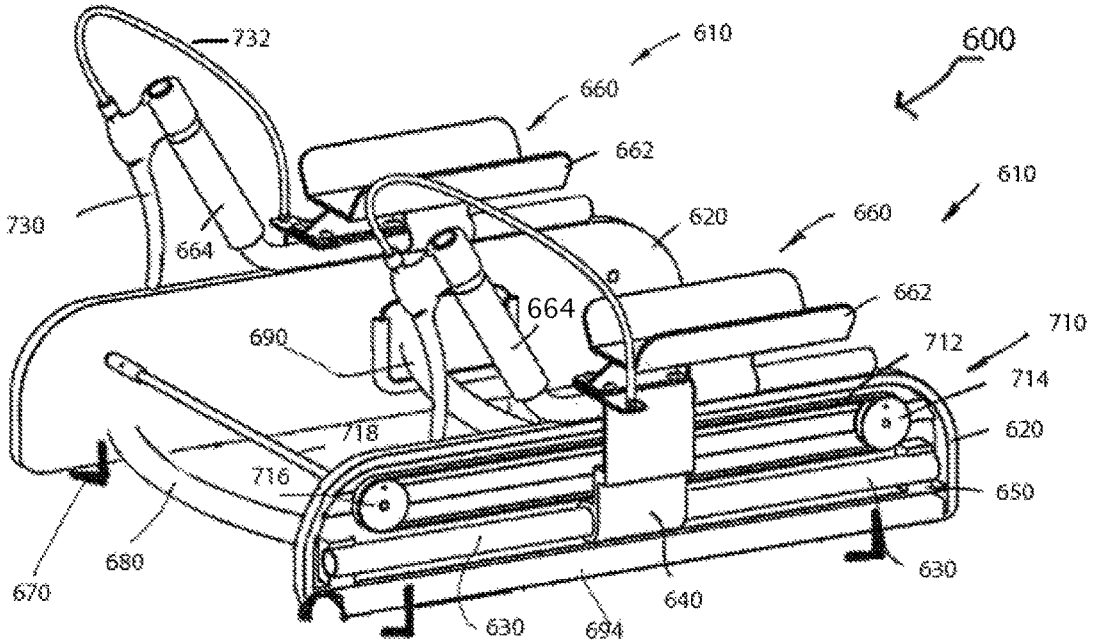
Figure 12A:
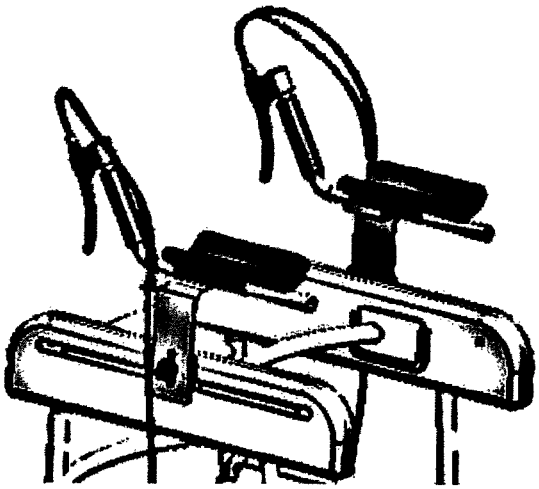
FIGS. 12A-12C show the three (3) support surface combination configurations, where
Figure 12B:
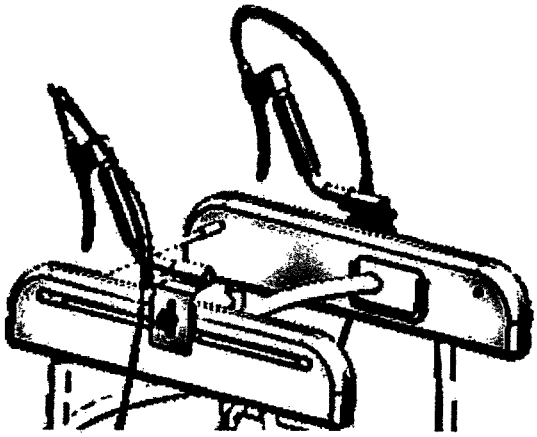
Figure 12C:
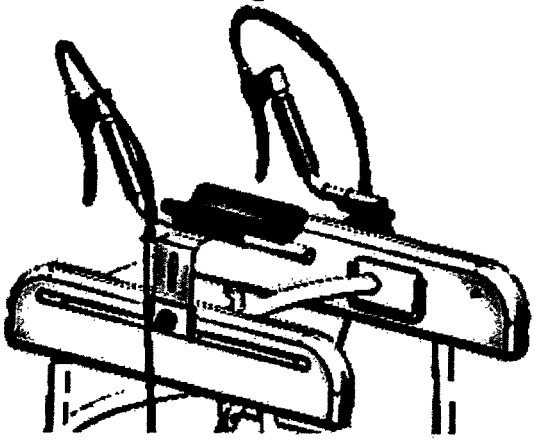
Figure 16A:
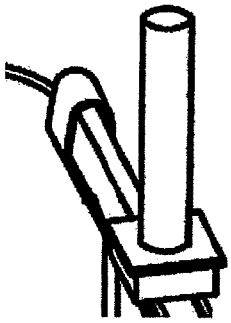
FIGS. 16A-16E show different grip handle assemblies which could be incorporated with any of the treadmill embodiments.
Figure 16B:
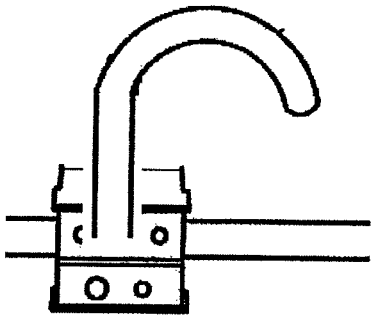
Figure 16C:
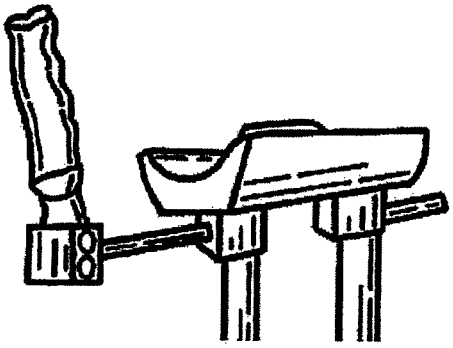
Figure 16D:
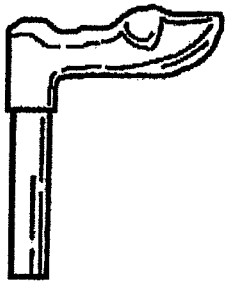
Figure 16E:
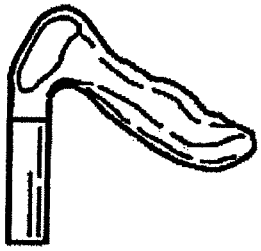
Figure 17A:
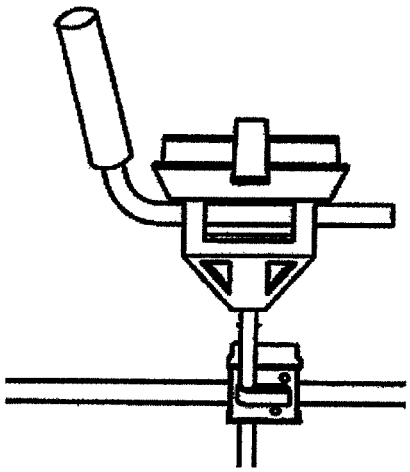
FIGS. 17A-17D show different forearm support assemblies which could be incorporated with any of the treadmill embodiments.
Figure 17B:
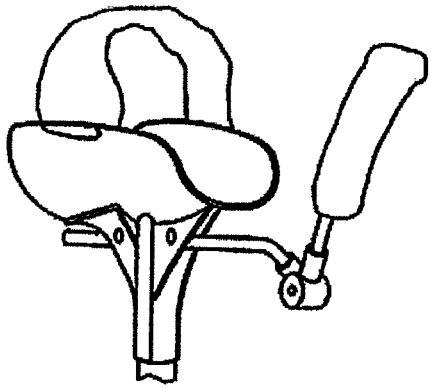
Figure 17C:
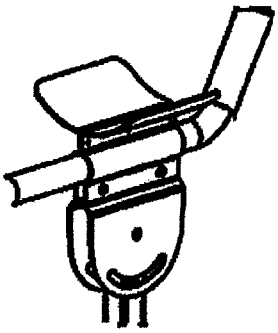
Figure 17D:
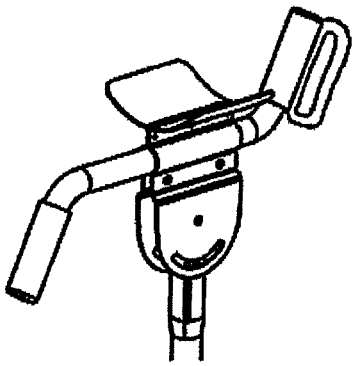

First and second support assemblies or carriages 610 are shown in FIGS. 8A and 8B. Each of the support assemblies 610 is mounted for selective sliding movement relative to a respective side of the one piece assembly 600. For ease of understanding and purposes of brevity, description of the structure and function of one support assembly 610 is deemed applicable to the other support assembly unless specifically noted otherwise. In a preferred arrangement, the support assembly 610 includes a housing 620 that extends along one side of the one piece assembly 600. A horizontal piece along a bottom of the casing 620 enclosed contents and is congruent on its underside with a top of the rail 630. In the preferred arrangement, the housing 620 encloses the rail 630 that extends horizontally along one side. The rail 630 is shown as a tubular rail, although the rail could also adopt other configurations. A mounting member 640 is slidably received over the rail 630 and is capable of linear movement relative to the rail both forwardly and rearwardly. Support members 650 that receive opposite ends of the rail 630 also serve as stop members to limit the longitudinal movement of the mounting member 640 on the rail. Secured to the mounting member 640 is a support member 660 which may be only the grip handle 664 or the grip handle and forearm supports 662, as a forearm support assembly includes grip handle. Note that the mechanism of attachment of the trough and grip handle supports slightly varies in design between FIGS. 8A and 8B. In embodiment of FIG. 8B, the mounting member 640 is non-adjustable so that the support member 660 is at a fixed height relative to the side of the one piece assembly. An adjustable mounting member would typically be preferable. Supports can be used in any combination: two forearm support assemblies (FIG. 12A), two grip handles (FIG. 12B), or one forearm support and one grip handle (FIG. 12C). The grip handle 664 is provided on each mounting member. The handle grip 664 is shown angularly mounted relative to horizontal (e.g., 60 deg. to 75 deg. from horizontal) and follows the natural contour of a user's fingers when a forearm is received, for example, in a forearm support 662 or when the grip handles are in a lower mounted and more forward position along the rail, as for gripping as opposed to forearm support. Mounting member 640 as noted above is preferably height adjustable. Particularly, slot 670 provides for selective raising and lowering of the mounting member 640 and likewise the forearm support member 660 relative to the side of the device 600. It is understood that other grip handle and forearm support designs could readily be introduced to this one piece assembly 600 by minor adjustments in the design of mounting member 640. For example, a horizontal grip handle such as shown in FIG. 16D would be more desirable than an angled grip in cases in which the user seeks static grip support on the treadmill.

As described above, the carriages or support assemblies 610 are mounted for sliding movement relative to a respective side of a railed device (e.g., treadmill, walker, parallel bars, etc.) and also movement relative to the other support assembly. The most desirable movement of one assembly (and hence UE) relative to the other, is reciprocating, i.e., one side advances forward while the other moves rearward, and vice versa. This coordinated action between the support assemblies 610 employs a mechanical connection or link 710 specifically a belt and pulley assembly that includes a drive belt 712 that forms a continuous loop about first (front) and second (rear) pulleys 714, 716. The pulleys 714 and 716 are axially spaced apart relative to one another and each rotate about a horizontal axis. The belt and pulley assembly 710 is located adjacent to the elongated rail 630 within the housing 620. Moreover, each of the front pulleys 716 is interconnected by a coupling shaft 718 to coordinate the movement between the right and left sides. Specifically, rotation of the front pulleys 716 are interconnected via a geared mechanism so that rotation of the belt in one direction on one side is opposite the rotational direction of the belt on the other side, and consequently as one carriage 610 on one side of the device moves forwardly, the carriage on the other side of the device moves rearwardly. Moreover, the carriages 610 move at the same velocity. Of course, the user can actively move UEs in reciprocating fashion when the coupling shaft 718 is disengaged from one or both of the pulleys 716, as well. The coupling shaft 718 is left disengaged if independent movement of the arms is desired for any of various reasons, such as when more weight is borne through the upper body and static positioning of one support surface is desired until after the opposite support surface has been advanced. The braking of the device 600 along the rail 630 may be desirable for this type of gait pattern, as well as other cases. This, of course, is just one mechanism that can achieve these desired movements and function, and other mechanisms are contemplated without departing from the scope and intent of the present disclosure.

The carriages 610 allow for very low resistance gliding along the tracks. The rigidity of the belt 712 is sufficient so as to enable one carriage 610 to effectively mobilize the opposite carriage with a flaccid limb resting on a forearm support 662, as would be needed in cases of one-sided UE dysfunction. Mechanization could readily be incorporated into the design of the device 600. With mechanization, continuous and consistent movement at selected velocity could be achieved. The specialized linkage offers many advantages, yet the coupling mechanism can also be disengaged to enable independent movement of the two UEs. When unlinked, additional concentration and focus is needed in order to actively cause the UEs to move in reciprocating fashion, hence (mental) fatigue may limit the training session duration in which cases coupling the motion of the assemblies 610 would be desirable.

At the lower end of the contents of the casing 620, below elongated rail 630, is a horizontal component 694 shaped so as to accept a rail of congruent shape.

The one piece assembly 600 is shown installed on a set of parallel bars in FIG. 7. With a simple modification of the device 600, rollers or bearings could be introduced to an underside of component 694, and the entire device could glide along rails as a user walks forward or backward. The assembly could also be secured in place using 670 for stationary activities in parallel bars such as marching in place or for working on UE movement while sitting or standing.

A hand brake 730 is also conveniently positioned relative to the handle grip 664. Actuating the handbrake 730 is intended to stop movement of the carriage 610 along the rail 630 as represented by cable 732. Four or more clamps 670 secure the one piece assembly 600 in static fashion to rails. The clamps 670 are preferably congruent with the shape of the rail the device is used with, such as round rails shown in FIG. 6, and square rails shown in FIG. 14.

The starting position of the support surfaces 660 can be altered when the coupling shaft 718 is disengaged. Once the assemblies 610 are placed in desired positions, the coupling shaft 718 is engaged. The assemblies 610 may be asymmetrically placed, for example, if both a grip 664 and a forearm support 662 are used. Otherwise, the supports would typically be symmetrically placed, and could be placed in the position representing neutral, i.e., in which the upper arm is neutral, or parallel to the midline of the body (i.e. in frontal plane). When shoulders are in this position, and grip handles 664 incorporated, the grip handles are placed more forward along the rail. When the forearm is supported, the assembly 610 is farther back. In either case, the same amount of shoulder movement fore and aft relative to the midline of the body results, regardless if grip handles 664 are moved back and forth or if supported forearms are moved back and forth.

Bar 680 provides for stability between parallel casings 620, as does the torso bar 690 which has end plates 692 (FIG. 8A) which are lowered into the pockets 694 on the inner surfaces of the housings 620. The torso bar 690 could be made to be adjustable for fore-aft and vertical positioning. Adjustability of the bar 680 is not shown in this embodiment, although such adjustment could be accommodated if deemed necessary. The abdomen of the user contacts the torso bar 690, and as such, the position of the torso and hence the feet relative to the treadmill and to the UE supports remains constant. This facilitates proper posture and safety is enhanced, as instability and fall hazard risk increase when a user's feet are too close or too far from the point of contact of the UE with the device 600.

Figure 9:
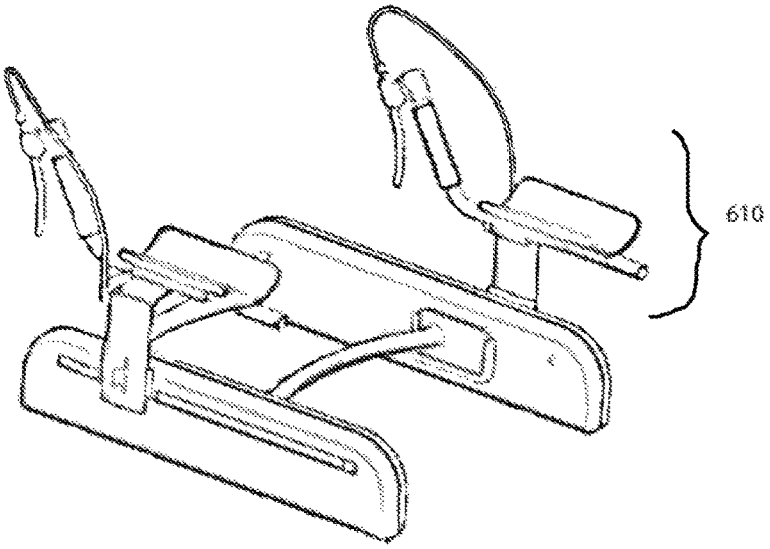
FIG. 9 shows the reciprocating arm movement assembly with forearm supports placed asymmetrically as would occur during use.
Figure 10:
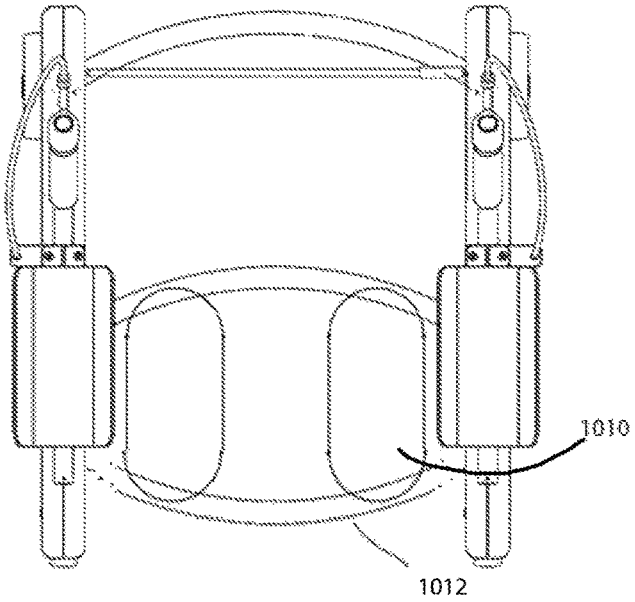
FIG. 10 is an illustration of the top view of the device placed upon parallel rails, with a user's feet placement illustrated.
Figure 11:
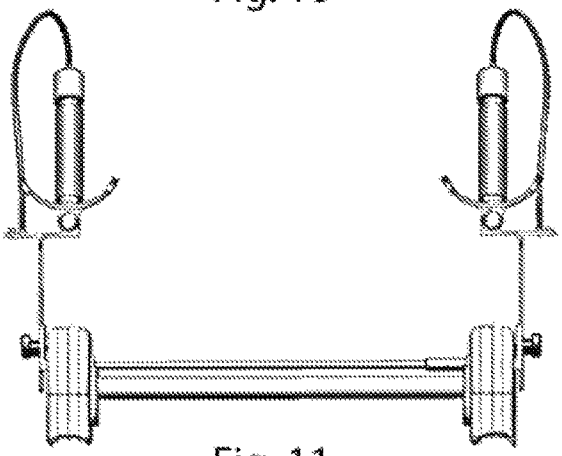
FIG. 11 is an illustration of the rear view of the device placed on railed device.

FIG. 9 illustrates assembly 600 with support assemblies 610 (forearm support assemblies 662 in this case) positioned asymmetrically, as would occur during use when the left arm has reached a more forward position and the right arm has reached a more rearward position. FIG. 10 is a top view of the assembly 600 showing feet positioning 1010. A belt 1012 can also be secured around the user, with attachment sites of the belt being preferably provided in the vicinity of the torso bar end plates 692. FIG. 11 is a rear view of the one piece assembly 600. FIGS. 12A-12C illustrate support surface combinations: two forearm supports (FIG. 12A), two grip handle supports (FIG. 128), and one forearm support and one grip handle support (FIG. 12C).

Figure 13:
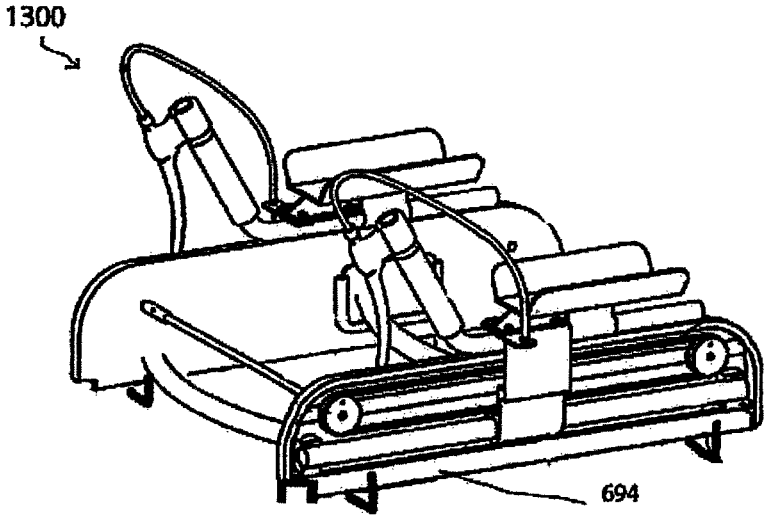
FIG. 13 shows a one piece reciprocating arm movement assembly which can be temporarily or permanently attached to a railed device, such as a portable treadmill as shown, and where the assembly is congruent with rectangular rails in this configuration.
Figure 14:
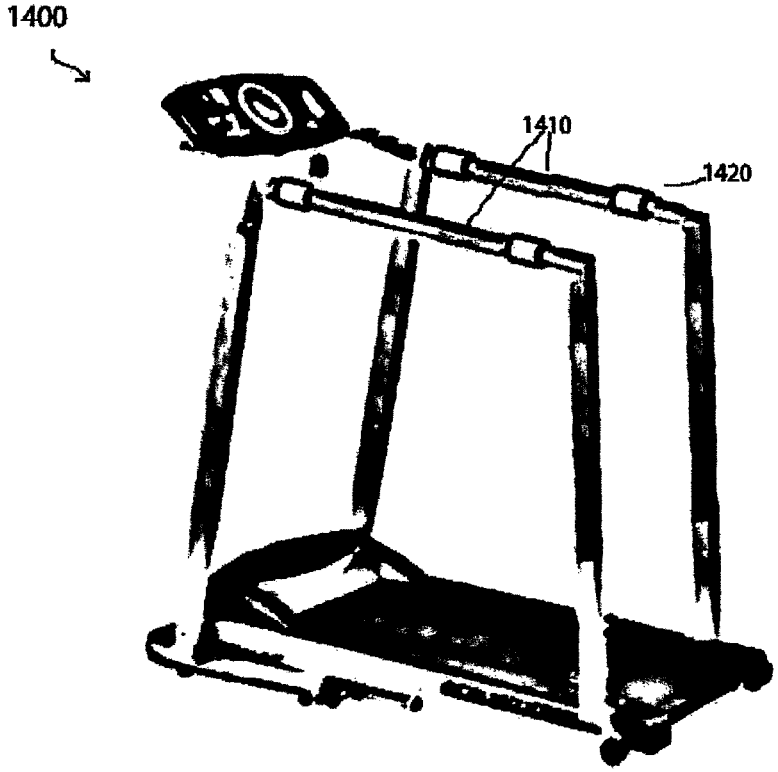
FIG. 14 shows a portable electric treadmill with square rails where two motion stop blocks are permanently attached to each of the two rails, positioned at the fore and aft ends of the assembly.
Figure 15A:
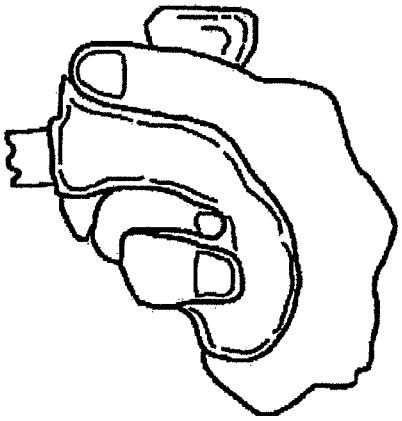
FIGS. 15A-15F show different handles, grips, orthoses to secure the wrist and hand to the grip handle component of grip handle assembly or forearm support assembly.
Figure 15B:
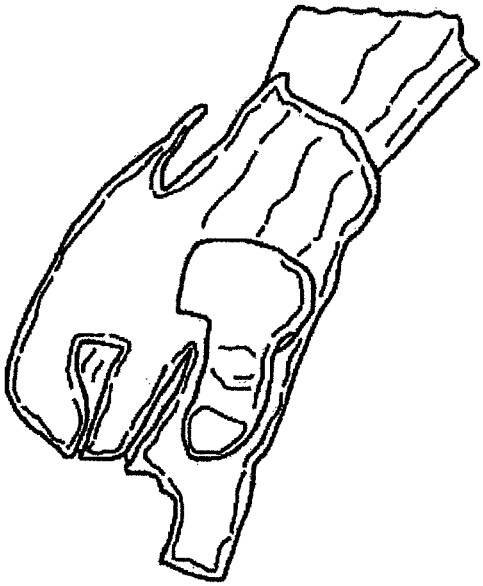
Figure 15C:
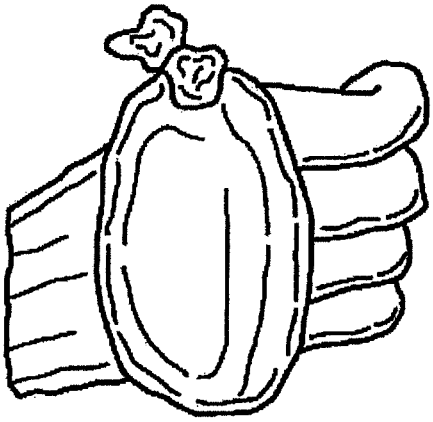
Figure 15D:
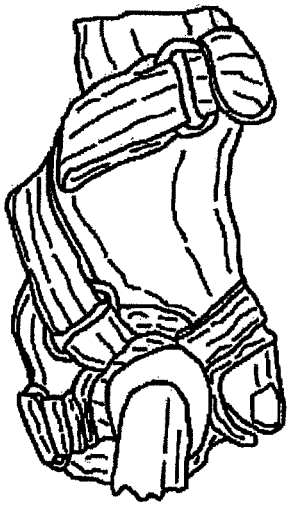
Figure 15E:
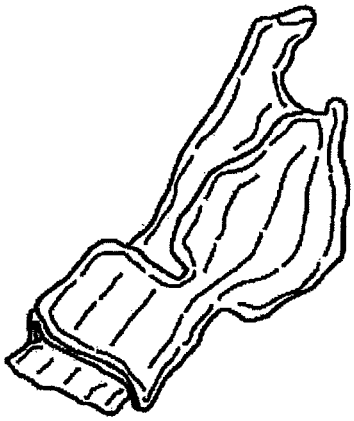
Figure 15F:
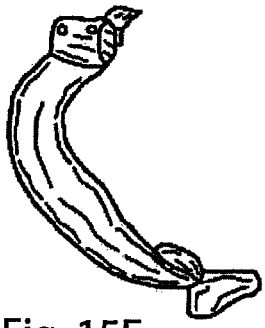

FIG. 13 shows the assembly 1300 which is identical to assembly 600 in FIG. 8B, except that (bottom member, 694) is configured to fit rectangular rail 1410 of a railed device such as portable electric treadmill 1400 shown in FIG. 14. Four motion stop blocks 1420 are placed, two on each rail, such that the assembly 1300 stays in place at desired locations on the railed device (treadmill).

In one embodiment, approximately 17.5 inches of total travel of a mobile support along one side is provided by the mechanism represented in the one piece assembly. Of course one skilled in the art will recognize that the noted dimensions are exemplary only and the present disclosure should not be unduly limited to these dimensions.

The carriages 610 can be connected with the reverse motion linkage or can be unlinked simply by removing the coupling shaft 718.

A user can use the one piece assembly 600 for static support of both UEs with the supports 660 locked in the neutral position.

The reciprocating arm movement treadmill embodiments presented herein enable functionally-relevant, repetitive reciprocating movement of the arms during ambulation activities while stepping at a selected velocity on the treadmill. The assemblies can also therapeutically be incorporated solely for upper body training while sitting or standing in the railed environment of a treadmill or other railed device. This type of treadmill will be used as a daily training tool, for those with neurological disorders as well as others.

Inclusion of force plates as a component of any of the support surfaces would be beneficial for monitoring the extent of UE weight bearing while using the treadmill. Auditory cuing could readily be incorporated via stimulation of a mechanism when a mobile assembly reaches the end of the translation range, for purposes of facilitating continuous and alternating stepping.

The mechanism introduced for reciprocating movement of the UEs as presented in any of these embodiments, could be linked to the electronically-controlled stepping mechanism intrinsic to other neurologic rehabilitation devices such as robotic exoskeletons and muscle stimulation systems, for purposes of enhancing gait training.

FIGS. 15A-15F show different handles, straps, and wrist/hand orthoses which can be used for example in conjunction with the cane handles or handle portions of forearm support assemblies such as forearm support 112 in FIGS. 1 and 3, or FIGS. 16, 17. Support surfaces are interchangeably attached. It is desirable to have means of readily securing the upper extremity (forearm, wrist, hand) for adequate contact and control of the device for optimal functioning.

FIGS. 16A-16E show various cane handles which could be readily introduced to the assemblies presented herein with simple modifications to the attachment mechanism.

FIGS. 17A-17D show various types of forearm support assemblies which could be readily introduced to the railed assemblies (treadmill, parallel bars, walkers, etc.) presented herein.

With the above-described devices, the following can be achieved. First, reciprocating (out of phase) arm movement, such as occurs during normal gait, without weight-bearing through the UE (upper extremities) can be achieved. Each of the two assemblies reciprocates upon its respective rail, in opposite directions, and can be achieved with an interconnecting linkage intact or disconnected. When intact, a stronger limb can mobilize a weaker limb in the reverse direction, excursion distance and movement velocity of the two assemblies are symmetrical, and mechanization thereof would create repetitive reciprocating arm movement such as would be desirable, for example, during repetitive stepping activities performed during treadmill training. When unlinked, reciprocating arm movement can occur as each of the two mobile assemblies is free to move upon its rail and the user actively moves the arms out of phase.

Second, two point gait is achieved, i.e., as the lower extremities (LE) move in reciprocating fashion, the upper extremities (UE) move in reciprocating fashion, out of phase yet concurrent with advancement of each of the LEs in turn, and each UE bearing weight to the extent needed to support the opposite LE.

Third, a four (4) point gait can be achieved with the above-described devices, namely, reciprocating UE and LE movement is out of phase as in the two point gait described above, as each UE in turn provides support for the opposite LE, to the degree needed. In contrast to the two point gait, with a four point gait, four distinct limb advancements in turn are made as each UE in turn is advanced prior to stepping with the opposite LE.

Fourth, a three point gait can be achieved such as a walker where the UE support assemblies necessarily move independently of each other. With the feet and walker frame stationary, the UEs are advanced together by gliding the assemblies forward, and the braking mechanisms (of wheels &/or assemblies along rail) are variably engaged. One LE is advanced, then the walker and opposite LE are allowed to advance as the brakes are released and the UEs return to the starting position. The second and third points of contact refer to each LE stepping in turn. Safety is enhanced as the distance the UEs can advance is delimited. Gait kinematics also improve as a result of the altered biomechanics. On a non-electric treadmill or treadmill offering slow belt speeds, a three point gait can be performed as follows: UEs are advanced, with or without braking, followed by stepping with one LE, then the UEs are brought back closer to the user's body as the user steps with the opposite LE.

One or both UEs can be statically positioned, such as on forearm support assembly.

In general, continuum of care in gait/ambulation/exercise training is achieved with these devices, as the same training can be performed on multiple devices in the clinic and in the home including parallel bars, treadmills, overground.

In contrast to using canes or crutches for performing two-point and four-point gaits, whereby the name of the gait pattern refers to the number of distinct contacts with the ground during one gait cycle, and wherein UE support is discontinuous as the mobility aid is intermittently in contact with the ground, these devices advantageously offer continuous UE support which is maximal at the time of (two-point) or prior to (four-point) LE contact. Transition from four-point to two-point gait is facilitated due to continuous UE support. As a user advances in technique, less support is needed. The nomenclature two-point and four-point gait patterns herein describe that there are two (2) and four time points during a gait cycle with maximal extremity loading. Hand brakes may variably be incorporated (walker and nonelectric treadmill) for either two-point or four-point gaits, depending on the degree of stability needed. The interconnecting linkage could be intact or disconnected, for either the two-point or four-point gait. If intact, the non-supporting UE would move posterior to the midline of the body, as the supporting UE support assembly is advanced. This may or may not be desirable or functional for a user, compared to the unlinked embodiment which would enable the opposite UE to remain in the resting/neutral position as the supporting upper limb as advanced, or to variably move through the full range of movement in both directions. An intact linkage would enable a stronger UE to mobilize a weaker UE in the case of one-sided weakness, and mechanization could be introduced to the linkage for repetitive, symmetrical, reciprocating UE movement. A non-motorized treadmill or motorized device capable of very low belt speeds would be needed to enable work on four-point gait with the treadmill embodiment.

This written description uses examples to describe the disclosure, including the best mode, and also to enable any person skilled in the art to make and use the disclosure. Other examples that occur to those skilled in the art are intended to be within the scope of the invention if they have structural elements that do not differ from the same concept, or if they include equivalent structural elements with insubstantial differences.

It is claimed:

1. A treadmill assembly comprising: a treadmill surface; first and second rails located on opposite sides of the treadmill surface; first and second upper extremity support assemblies each configured for sliding movement on the first and second rails, respectively, wherein the sliding movement of the first upper extremity support assembly upon the first rail does not impact the sliding movement of the second upper extremity support assembly upon the second rail, the upper extremity support assemblies including at least one of: (i) first and second forearm supports operatively associated with the first and second rails, respectively, (ii) first and second sliding grips or grip handles operatively associated with the first and second rails, respectively, or (iii) a first forearm support operatively associated with the first rail and a first hand grip operatively associated with the second rail; and further comprising an interconnecting reverse motion linkage operatively associated with the first and second upper extremity support assemblies configured for sliding movement, the reverse motion linkage including a first engaged state configured to enable interrelated, equal movement in opposite directions of the first and second upper extremity support assemblies and a second disengaged state configured to enable independent movement of the first and second upper extremity support assemblies along the first and second rails.

2. The assembly of claim 1 further comprising first and second sleeves mounted on first and second tracks on the first and second rails, respectively.

3. The assembly of claim 2 wherein the first and second upper body supports are received on the first and second sleeves, respectively.

4. The assembly of claim 1 wherein at least one of the first and second upper extremity support assemblies further includes a brake to selectively stop movement of at least the first upper extremity support assembly relative to the first rail.

5. The assembly of claim 1 further comprising a torso bar extending between the first and second rails.

6. The assembly of claim 1 further comprising first and second sleeves mounted first and second tracks on the first and second rails, respectively, each of the tracks having an arcuate conformation.

7. The assembly of claim 1 further comprising first and second sleeves and a curved track that extends between the first and second sleeves.

8. The reverse motion linkage of claim 1 wherein each of the first and second upper extremity support assemblies includes a pulley and belt that together form a pulley and belt assembly wherein the first upper extremity support assembly is attached to an upper part of the belt, the second upper extremity support assembly is attached to a lower part of the belt, and a coupling shaft coordinates movement in the same direction of the first and second pulley and belt assemblies to create equal movement in opposite directions of the upper extremity support assemblies.

9. The assembly of claim 1 wherein the interconnecting reverse motion linkage includes a belt and pulley assembly that includes a flexible member received around first and second pulleys, and the belt and pulley assembly is interconnected to the first and second upper extremity support assemblies, respectively, so that rotation of the flexible member causes the first and second upper extremity support assemblies to slide in opposite directions along the first and second rails.

10. An assembly for placement upon an associated railed device having associated first and second parallel rails, comprising:

first and second rails;

first and second upper extremity support assemblies configured for sliding engagement on the first and second rails, respectively; and an interconnecting reverse motion linkage operatively associated with the first and second upper extremity support assemblies, and configured to create equal sliding movement in opposite directions of the first and second upper extremity support assemblies relative to the first and second rails, respectively, wherein the assembly is configured for receipt on the associated first and second parallel rails.

11. The assembly of claim 10 further comprising an interconnecting member extending between and configured to be selectively, operatively connected and disconnected to the first and second upper extremity support assemblies.

12. The assembly of claim 10 further comprising an interconnecting member extending between the first and second upper extremity support assemblies.

13. The assembly of claim 10 further comprising:

first and second housings;

an interconnecting member between first and second housings; and first and second mounting members that mount the first and second housings on the associated first and second parallel treadmill rails, respectively, of the associated railed treadmill device.

14. The assembly of claim 13 wherein the first and second housings are interconnected by a torso engaging member.

15. The assembly of claim 14 further comprising a belt that spans at least partially between the first and second upper extremity support assemblies and around a posterior portion of the associated user.

16. The assembly of claim 10 comprising first and second housing mounts configured for one of (i) sliding movement on the associated first and second parallel treadmill rails of the associated railed treadmill device, or (ii) static positioning on the associated first and second parallel treadmill rails of the associated railed treadmill device.

17. The assembly of claim 10 wherein at least one of the first and second upper extremity support assemblies further includes a brake to selectively stop the sliding movement of the at least first upper extremity support assembly relative to the first rail.

18. A treadmill comprising:

a treadmill surface;

first and second rails located on opposite sides of the treadmill surface;

first and second sleeves configured for sliding movement on the first and second rails, respectively; and an interconnecting member extending between and selectively, operatively connected to both of the first and second sleeves, and configured to (i) manage equal sliding movement of the first and second sleeves in opposite directions in a longitudinal direction of the rails when connected to each of the first and second sleeves, and (ii) permit independent sliding movement therebetween when disconnected from at least one of the first and second sleeves.

19. The assembly of claim 18 wherein the sleeves are configured to prevent rotation relative to the rails.

20. The assembly of claim 18 further comprising a lining in each sleeve that facilitates sliding movement of the sleeve.

21. The assembly of claim 18 wherein the sleeve is hollow and received on the rail that is either round or non-round in cross-section.

* * * * *